United States Patent [19]

Streit et al.

[11] 4,266,261

[45] May 5, 1981

[54] METHOD AND APPARATUS FOR OPERATING AN ELECTROMAGNETIC LOAD, ESPECIALLY AN INJECTION VALVE IN INTERNAL COMBUSTION ENGINES

[75] Inventors: Klaus Streit, Tübingen; Klaus Harsch, Ditzingen; Peter Schülzke, Hemmingen, all of Fed. Rep. of Germany

[73] Assignee: Robert Bosch GmbH, Stuttgart, Fed. Rep. of Germany

[21] Appl. No.: 51,588

[22] Filed: Jun. 25, 1979

[30] Foreign Application Priority Data

Jun. 30, 1979 [DE] Fed. Rep. of Germany ..... 2828678

[51] Int. Cl.[3] ..... H01H 47/32

[52] U.S. Cl. ..... 361/154; 361/194

[58] Field of Search ..... 361/152, 154, 194

[56] References Cited

U.S. PATENT DOCUMENTS

| | | | |
|---|---|---|---|
| 3,786,314 | 1/1974 | Misch | 361/154 |
| 3,909,681 | 9/1975 | Campari et al. | 361/154 |
| 4,176,387 | 11/1979 | Harper | 361/154 |
| 4,180,026 | 12/1979 | Schulzke et al. | 361/154 X |

*Primary Examiner*—Harry E. Moose, Jr.
*Attorney, Agent, or Firm*—Edwin E. Greigg

[57] ABSTRACT

A method is proposed for operating an electromagnetic load device with a movable armature, especially an injection valve of an internal combustion engine. The load device is supplied, at the beginning of trigger pulse, with a high amperage current and, at least toward the end of the pulse, with a reduced current. This method is characterized in that, starting with a certain amperage, at which preferably the armature is set into motion but has not as yet reached its final position, the current rise is at least reduced. The apparatus aspect comprises a measuring element and switching element connected in series with the load device. A threshold switch is associated with the measuring element to control the switching element. The switching thresholds of the threshold switch can be controlled in dependence on current and/or on time. The first current threshold is at a value at which the armature of the load is preferably being moved, but has not yet reached its final position. The method and the apparatus achieve a low power operation of the load device with a coincidence factor between the trigger pulse signal and, for example, the switching characteristic of an injection valve. It is essential that the current flow, after the starting current, no longer continue to rise in the same way but rather, if possible, is already somewhat reduced and, after the armature of the load has been attracted, a holding current is established as a function current and/or time. With a view toward a clear cut-out characteristic, a short term current supply to the load is advantageous at the end of the actual trigger pulse signal.

29 Claims, 15 Drawing Figures

METHOD AND APPARATUS FOR OPERATING AN ELECTROMAGNETIC LOAD, ESPECIALLY AN INJECTION VALVE IN INTERNAL COMBUSTION ENGINES

BACKGROUND OF THE INVENTION

The present invention relates to a method and apparatus for controlling the operation, and in particular the current flow, of an electromagnetic load such as a fuel injection valve.

It is conventional to apply a high-amperage current to injection valves at the beginning of a trigger pulse, and to maintain the high-amperage current until the injection valve has opened at which time the control current reaches a lower and substantially constant value. Once the fuel injection solenoid valve is opened, no other mechanical work needs to be performed, and therefore a smaller current is sufficient for maintaining the open position of the valve than is required for opening the valve itself.

In the conventional valve control system, a series connection of load and current measuring device is connected directly in parallel to an energy source until the solenoid valve has been securely attracted. Only thereafter is the valve current reduced to the level of a holding current and maintained at the same value until the end of the excitation signal trigger pulse. Also, a corresponding device has been known wherein the subsequent holding current is timed, i.e., the current supply to the load is cut in-and-out in dependence on the current. With the aid of this device, a reduction in power consumption can be achieved at least during the holding phase.

It has now been found that the timing of the current supply during the holding phase alone does not as yet represent an optimum condition insofar as energy consumption of an injection valve is concerned. Although the requirements regarding a maximally timed opening and closing of the valve are satisfactorily met.

OBJECT AND SUMMARY OF THE INVENTION

It is an object of this invention to provide a method and apparatus for electromagnetic loads with a movable armature, which method and apparatus are optimized with respect to timing as well as consumption characteristics.

The method of this invention ensures the operation of an electromagnetic load at minimum power consumption. At the same time, a time conforming behavior is attained for the armature movement and the excitation signal.

It is particularly advantageous to effect a reduction in current flow through the load in a chronologically staggered fashion. Furthermore, for the freewheeling circuit employed, a short term increase in current flow at the end of an injection signal proved to be suitable in order to provide clear relationships for the cut-off moment for the freewheeling circuit. This is of importance, above all, when using thyristors as a switch in the freewheeling circuit.

A combined current-time control of the on-off switching moments of the switching element in series with the load proved to be especially suitable because the current measuring device can be arranged outside of the freewheeling circuit and thus no power loss is produced during the freewheeling periods as a result of the current measuring device. It is particularly advantageous if the freewheeling circuit can be switched on or off at certain times and/or at certain current levels through the load, since with the aid of this control an arbitrary current reduction can be executed in a simple way at desired points in time and at desired operating conditions.

BRIEF DESCRIPTION OF THE DRAWINGS

Various embodiments of the invention are illustrated in the drawings and will be explained in greater detail in the description below. In the drawings.

DETAILED DESCRIPTION OF THE PREFERRED EMBODIMENTS

The preferred embodiments are adapted for controlling an electromagnetic injection valve.

Figure 1:
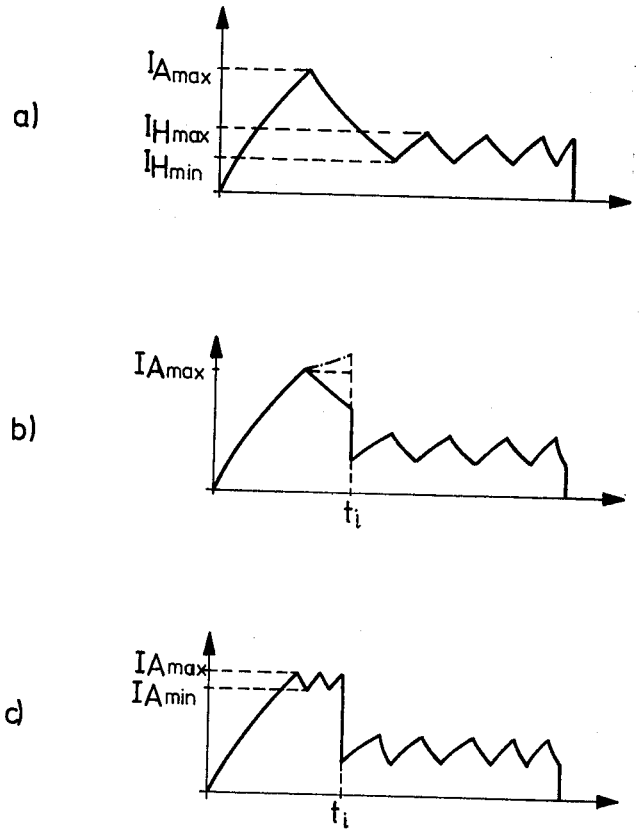
FIGS. 1*a* through 1*c* show, generally, different possible profiles of the current profile through an electromagnetic load device according to the method of this invention in order to operate the load device.

FIGS. 1*a*–1*c* illustrate different current profiles of the current through the excitation winding of the electromagnetic solenoid valve. The current is plotted as a function of time. All three profiles have the common feature of an initial current rise to a maximum value ${}^{I}A_{max}$. This is followed by a phase with a current ranging above a holding current value, and finally by a holding phase (${}^{I}H_{max}-{}^{I}H_{min}$) with the holding current prevailing for the remaining time interval to the end of the desired excitation of the injection valve. The thus determined co-called starting current is suitably found empirically. In principle, it is unnecessary for the armature itself to begin its motion at the point in time when this starting current has been reached. Whether the armature will move upon reaching this current value depends on the inertia of the movable parts in the injection valve, and also on the flank steepness of the starting current. The only important point is the capability of the armature to detach itself from its rest position during this current flow and to execute a stroke motion.

The phase following the initial current rise, which is one of relatively high-amperage ensures that the armature passes to its final position. Only thereafter can the current through the excitation winding of the injection valve then be reduced to the holding current.

The individual current values, as well as the time intervals of the various current values are to be adapted primarily to the type of injection valve employed. In addition thereto, the power capacity and/or the internal resistance of the current source utilized for the injection valve play a part as well.

In the diagram of FIG. 1*a*, the valve current rises to a maximum current $^{I}A_{max}$. Thereafter, the current gradually decreases via a freewheeling circuit, discussed hereinafter, and enters a current-controlled holding phase to the end of the excitation pulse. During the holding phase the current oscillates between the values $^{I}H_{min}$ and $^{I}H_{max}$. In this connection, the freewheeling circuit is designed with a view toward a gradually fading current flow, wherein the shortest injection pulses occurring yield a limit value. A rapid drop-out of a solenoid valve presupposes a maximally low stored energy, i.e., the current flowing through the valve winding should not range above the holding current at the instant of cut-off.

With a current flow through the winding of the injection valve according to FIG. 1*b*, an ensured response of the solenoid valve is possible even with brief injection pulses. At the same time, a rapid drop-out of the valve is assured. This can be realized by switching off the freewheeling circuit, wherein the instant of switch-off must lie before the end of the shortest possible injection pulse. Two other possible current flows following the point of maximum current, or the point at which the starting current is reached, are indicated in dashed lines and in dot-dash lines in FIG. 1*b*. According to one possibility (dashed lines) the starting current is kept constant until the aforementioned time has elapsed ($t_1$). According to the other possibility (dot-dash lines) a rise in the current occurs. This rise can have a substantially flatter slope, since the armature has already been lifted from its rest position due to the starting current and moved in the direction of its stop. The particular current flow or path selected after reaching the starting current is dependent on many factors, for example, the permissible power loss, and the need for a safe activation. In each of the last-mentioned current flows, the power expenditure is higher than in case of a pure, controlled freewheeling circuit.

FIG. 1*c* shows a further possibility of the type of current flow desired. The profile here is characterized by a timed control of the current supply to the injection valve, wherein the switching points are fixed by varying current threshold values.

FIGS. 2*a*–2*e* show various diagrams essential in conjunction with the current profile shown in FIG. 1*a*.

FIG. 2*a* shows the trigger pulse $t_i$ of the final switching stage for the solenoid valve. This pulse signal is produced in a pulse generating stage (not shown), which receives engine speed and load values and is optionally corrected for temperature.

The illustration in FIG. 2*b* corresponds essentially to the curve of FIG. 1*a*. One section in the center of the holding phase has been expanded timewise and, at the end of the $t_i$ pulse, there follows an additional current flow interval of a specific duration. The diagram of FIG. 2*b* shows a rapid rise of the current at the beginning of the injection pulse $t_i$ and a current drop following the attainment of an $I_1$ threshold. This current drop is effected via a freewheeling circuit. During the subsequent holding phase the current oscillates between two current limiting values ($^{I}H_{max}$ and $^{I}H_{min}$) until the $t_i$ pulse has passed. The holding phase is followed by a short-term current rise of a constant duration to obtain a uniform, defined condition for the switching of the freewheeling circuit.

FIG. 2*c* shows the voltage at the collector of a switching transistor for the solenoid valve current. In this context, the transistor conducts when the voltage value is zero. This is the case whenever the current according to FIG. 2*b* shows a positive upward slope. At the end of the additional activating time $t_k$, following the injection pulse $t_i$, this voltage, due to the cut-out freewheeling circuit, reaches very high values and thereafter drops again to the voltage value of the condition without current flow.

In FIG. 2*d*, the limit values are plotted for a threshold value switchover, marking the switching points from the conductive and nonconductive conditions of the transistor as the current switching element. At the beginning of the $t_i$ pulse, the current flow must reach the high value of the starting current, and for this reason the desired value has also been chosen to be high. Subsequently, the threshold value is lowered to the minimum value of the holding current and then alternates from one switch-over instant to the next switch-over instant between the maximum and minimum values for the corresponding holding current. At the end of the $t_i$ pulse, the desired value again assumes a high magnitude and thus again enters the starting position.

FIG. 2*e* shows the switching condition of the freewheeling circuit. In the indicated example, the freewheeling circuit is switched in parallel with the duration of the injection pulse. In this way the current drops during the entire duration of the injection pulse $t_i$ and then, after passage of the additional period $t_k$, a strong and thus rapid current drop for a maximally accurately definable cutoff of the injection valve. No change would result in the signal characteristic of the current according to FIG. 2*b* if the freewheeling circuit were to be switched on only during the fading phases of the current, but this would require added expense without improved results. A switching of the freewheeling circuit during the injection period is required only after the curves of FIGS. 1*b* and 1*c* are realized. This will be described more fully below.

Figure 2:
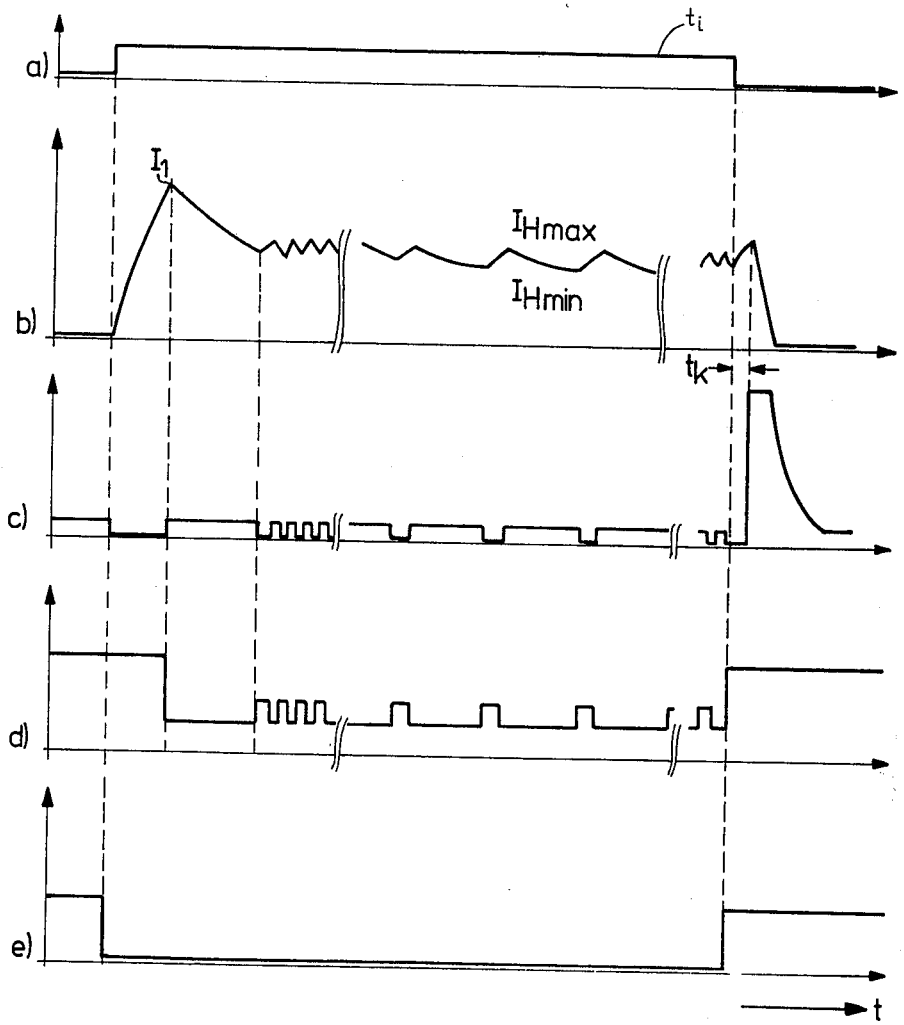
FIG. 2*a* more accurately depicts the current profile of FIG. 1*a*.
FIG. 2*b* illustrates the trigger pulse for FIG. 2*a* and FIGS. 2*c*–2*e* are pulse diagrams associated with the current profile in FIG. 2*a*.
Figure 3:
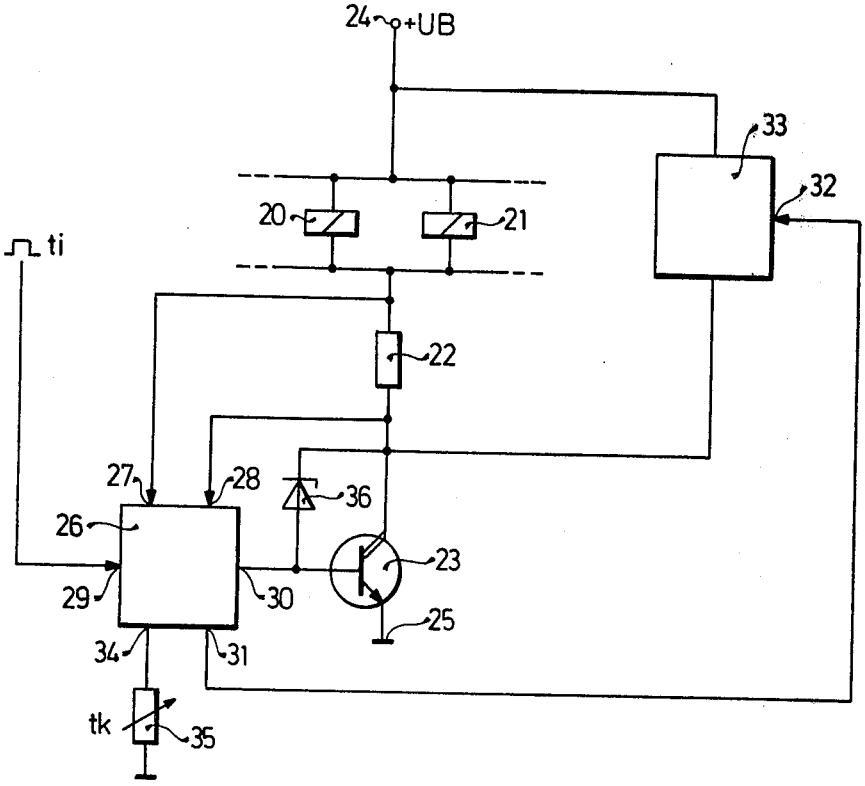
FIG. 3 schematically illustrates a possible circuit to realize the current profile shown in FIG. 1*a;*

The block circuit diagram of FIG. 3 realizes the current profiles of FIGS. 1*a* and 2*b*. One or more injection valves 20 and 21 are connected in parallel with each other and in series between a positive potential terminal 24 and a ground terminal 25 with a measuring resistor 22 and the collector-emitter path of a transistor 23. A two-position controller 26 receives a current measuring signal from the measuring resistor 22 via two inputs 27 and 28. The actual input signal to the two-position controller 26 is fed via an input 29 to which are applied the $t_i$ pulses as injection pulses. A first output 30 of the two-position controller 26 leads to the base of transistor 23, and a second output 31 leads to an input 32 of a freewheeling control circuit 33. The circuit 33 is situated in parallel with the series circuit of injection valves 20 and 21 and measuring resistor 22. Finally, a variable resistor 35 is connected between a connecting point 34 of the two-position controller 26 and ground. The resistor 35 sets the additional time period $t_k$. A Zener diode 36 is connected between the base and collector of transistor 23 for a rapid fading of the current at the end of the injection pulse.

In the circuit of FIG. 3, the measuring resistor 22 is constantly connected in the circuit of valves 20 and 21. When the transistor 23 conducts, the current which flows through transistor 23 also flows through the resistor 22. When the transistor 23 blocks, a current passes through the measuring resistor 22 which flows through the freewheeling circuit 33. Since the voltage drop across the measuring resistor 22 indicates the current through the injection valves 20 and 21 at any point in time, it is advantageous, in the present arrangement, to provide a pure current control of the two-position controller 26, i.e., a control in which the current flow is like that of FIG. 2*b* where the switching points are determined solely by the current. A time control of the switchover of the two-position controller is, therefore, unnecessary.

Figure 4:
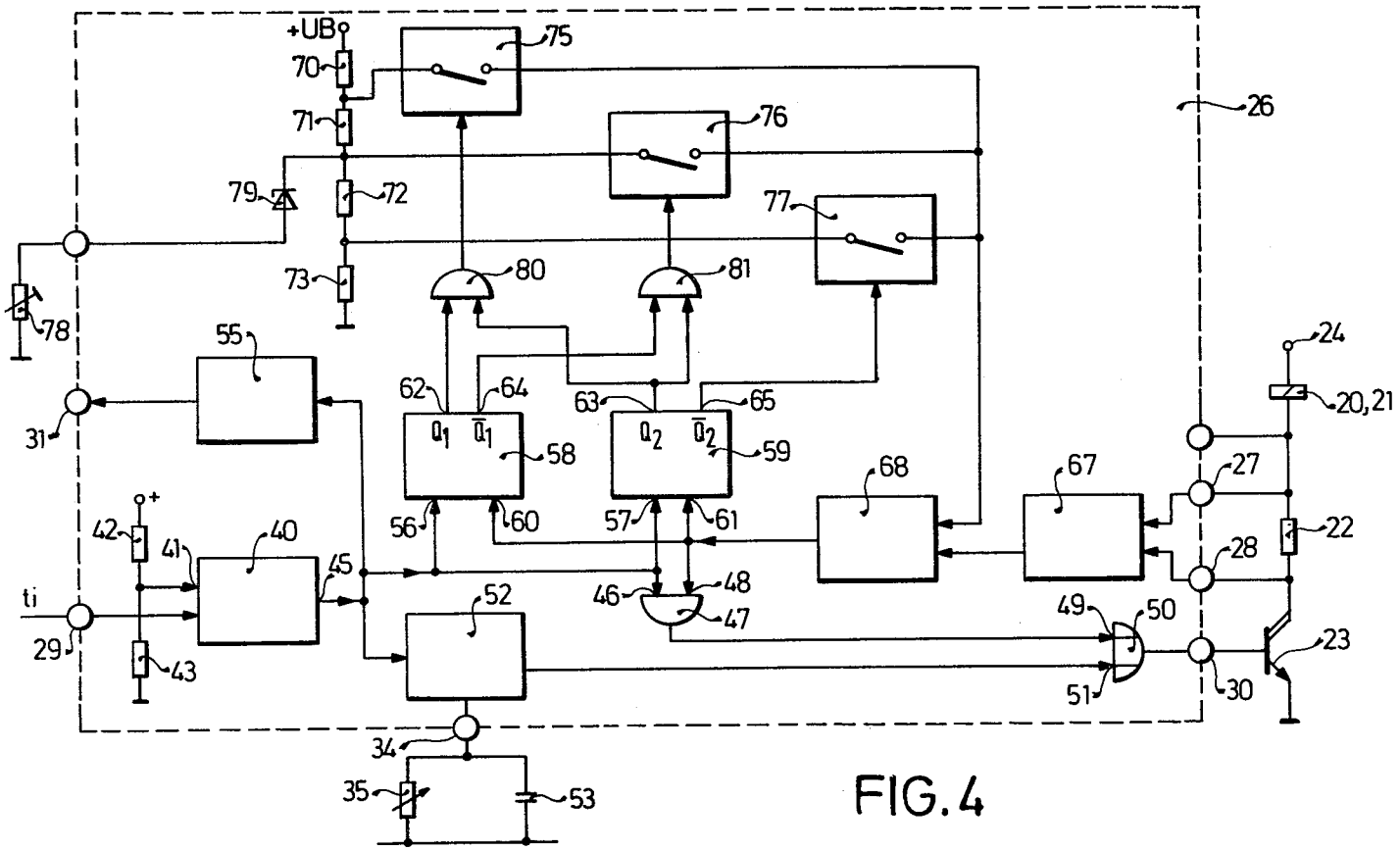
FIG. 4 illustrates a block circuit diagram of a two-position controller usable in the circuit of FIG. 3.

A block circuit diagram of the two-position controller 26 is shown in FIG. 4. In FIG. 4, like components and connections with respect to FIG. 3 carry the same reference numerals. A threshold switch 40, with a comparison input 41, is connected to the input 29 and receives the $t_i$ pulses. The comparison input 41 is connected to a voltage divider made up of two resistors 42 and 43 between the terminals of a voltage source. The output 45 of the threshold switch 40 is connected to a first input 46 of an AND gate 47, the output of the latter being connected, in turn, to an input 49 of an OR gate 50. The output of this OR gate 50 is connected to the output 30 of the two-position controller 26 and controls the base potential of transistor 23.

The output 45 of the threshold switch 40 is also applied to a monostable multivibrator stage 52 for formation of the additional pulse of duration $t_k$ after elapse of the injection pulse $t_i$. For this purpose, the monostable multivibrator stage 52 is triggered by the negative flank of the output signal of the threshold stage 40. The duration $t_k$ of the monostable multivibrator stage 52 can be set via the input 34 of the two-position controller 26 by means of the variable resistor 35, the latter being connected in parallel with a capacitor 53. The output of the monostable multivibrator stage 52 is connected to the second input 51 of the OR gate 50. Also, the output 31 of the two-position controller 26 for the control pulses of the freewheeling circuit 33 is connected through an amplifier 55 to the output 45 of the threshold switch 40. The inputs 56 and 57 of two logic gate circuits 58 and 59, respectively, are connected to the output 45 of the threshold stage 40. Each of the logic gate circuits 58 and 59 has still another input 60 and 61, respectively, as well as two outputs 62, 64 and 63, 65, respectively.

The inputs 27 and 28 of the two-position controller 26, are coupled via a differential amplifier 67 with the negative input of a threshold switch 68. On the output side, this threshold switch 68 is connected to the inputs 60 and 61 of the logic gate circuits 58 and 59, as well as to the second input 48 of the AND gate 47.

A series connected multistage voltage divider consisting of four resistors 70–73 is provided between the operating voltage terminals for the formation of current threshold values (see FIGS. 2*b* and 2*d*). The junction points between the individual resistors are linked via controllable switches 75, 76, and 77 to the positive input of the threshold switch 68. The individual threshold values can be set by way of a variable resistor 78 which is connected in series with a Zener diode 79 and is arranged in parallel to the series circuit of the two resistors 72 and 73.

Which of the threshold values is to be effective, or which of the switches 75–77 is to be turned on is determined by the relationship of the potentials at the outputs 62–65 of the logic gate circuits 58 and 49. Two AND gates 80 and 81 serve for linking these output signals. The first AND gate 80 receives its two input signals from outputs 62 and 63 of the logic gate circuits 58 and 59 and is connected at its output to the control input of the switch 75. Correspondingly, the AND gate 81 received input signals from the outputs 63 and 64 of the logic gate circuits 58 and 59 and, in turn, controls the switch 76. Finally, the output 65 of the logic gate circuit 59 is in direct connection with the control input of switch 77.

The threshold values for the valve current can be those shown in the diagram of FIG. 2*d*. These threshold values are applied in chronological sequence to the positive input of the threshold switch 68. Until the activating current value $I_1$ has been attained, a high current threshold value is required, i.e., the switch 75 of FIG. 4 must be turned on. During the subsequent switchover to the smallest threshold value, the switch 77 must be closed and, at the threshold of the maximum holding current, the switch 76 must be conductive. Due to the interconnected logic by the AND gates 80 and 81, the output values of the logic gate circuits 58 and 59 must be chronologically staggered as follows.

Until the activating or starting current $I_1$ has been attained, a positive signal must be present at the outputs 62 and 63, i.e., $Q_1$ and $Q_2$. To render the threshold value of the minimum holding current effective, a positive signal must be present at output 65 and thus at $\overline{Q}_2$. For the thresholds of maximum holding current, positive output signals must appear at outputs 64 and 63, i.e., $\overline{Q}_1$ and $Q_2$.

One of the input signals of the logic gates 58 and 59 is a signal from the output 45 of the threshold switch 40, corresponding to the $t_i$ signal. Furthermore, the logic gate circuits 58 and 59 receive, respectively, one output signal from the threshold switch 68. One input of the threshold switch 68 has applied thereto a value related to the current flowing through the measuring resistor 22, and the second input of the threshold switch is supplied with the respective threshold values. The output signal of the threshold switch 68 corresponds to the reciprocal of the signal curve according to FIG. 2*c*, due to the actuation of the switching transistor 23 via the AND gate 47 and the OR gate 50.

The essential switching processes of the two-position controller 26 take place in the logic gates 58 and 59. Due to their significance, a circuit example with associated pulse diagrams has been illustrated in FIGS. 5 through 8 for each of the logic gate circuits.

Figure 5:
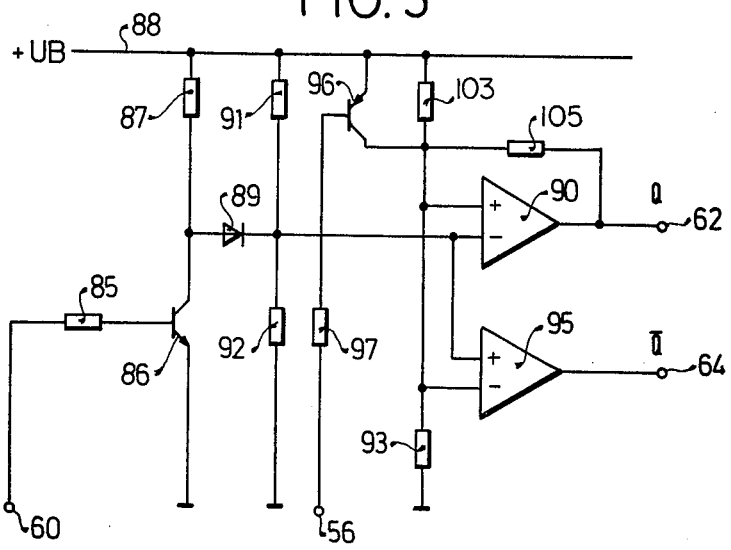
FIG. 5 is a detailed illustration of the logic gate 58 of FIG. 4.

FIG. 5 shows logic gate circuit 58. The reference numerals used in FIG. 4 are employed here for the same inputs and outputs which are also present in the arrangement of these figures.

The input 60 is connected via a resistor 85 with the base of a transistor 86, the latter being connected to ground via its emitter and being connected, on the collector side, via a resistor 87 to a positive line 88. The collector of transistor 86 is furthermore connected, via a diode 89, to the negative input of an amplifier 90. At the same time, this negative input constitutes the connecting point between two resistors 91 and 92, which are connected in series to the positive line 88 and ground. The positive input of the amplifier 90 is connected through a resistor 103 to the positive line 88 and through the resistor 93 to ground. It is also connected with the negative input of a further amplifier 95 and to its own output through a resistor 105. The resistor 103 can be short-circuited by means of a transistor 96, the base of which is connected to input 56 via a resistor 97, and the collector of which is connected to the output of the amplifier 90 via the resistor 105. The resistors 103 and 105 are of the same resistance valve as resistors 91 and 92, respectively. The outputs 62 and 64 of the logic gate circuit 58 correspond to the outputs of amplifiers 90 and 95.

Figure 6:
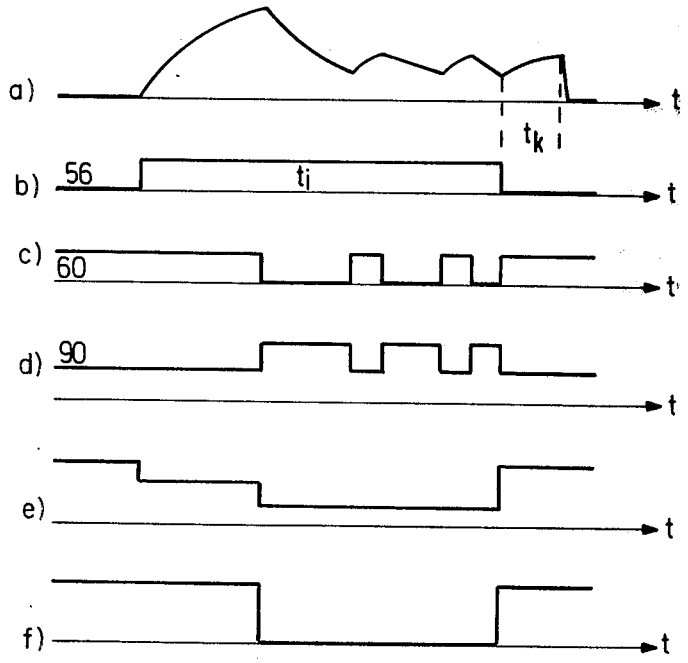
FIG. 6*a* illustrates the current profile and FIGS. 6*b* through 6*f* the pulse diagrams associated with the logic gate 58 of FIG. 5 for explaining the operation of the logic gate 58.

The pulse diagrams of FIG. 6 pertain to the circuit of FIG. 5. FIG. 6*a* shows, in a simplified illustration, the valve current through the solenoid valves 20 and 21. FIG. 6*b* shows the signal at input 56, corresponding essentially to the injection signal $t_i$. The output signal of the threshold switch 68, which is applied to the input 60, is shown in FIG. 6*c*. The positive potentials are in synchronism with the current rises through valves 20 and 21, as shown in FIG. 6*a*, wherein the signal relationship is naturally reversed, but the illustration is simpler when starting with the valve current.

FIG. 6*d* indicates the input signal at the negative input of the amplifier 90. In the rest position, this negative input is at half the operating voltage due to the equivalent resistors 91 and 92. Only when the transistor 86 is blocked does this input potential reach higher voltage values than half the battery voltage. FIG. 6*e* indicates the voltage at the positive input of the amplifier 90. The signal curve has two steps, wherein the first step marks a voltage reduction from $U_B$ to $2U_B/3$ and the further step finally drops the voltage to a voltage value of $U_B/3$.

Before the first current rise according to the diagrams of FIG. 6*a*, a zero potential is present at input 56, and for this reason the transistor 96 is conductive. As a result, a very high potential is applied to the positive input of the amplifier 90, which in turn provides the full voltage signal at output 62. If the potential at input 56 rises in accordance with the diagram of FIG. 6*b*, then the transistor 96 does not conduct, and the potential at the positive input of the amplifier 90 drops to a value of two-thirds of the operating voltage. This is so, because the two resistors 103 and 105 both affect the positive input value, and the resistor 93, which is equivalent to the other resistors, is connected to ground. As long as there is still a positive signal at input 60, transistor 86 is conductive, the voltage $U_B/2$ is present at the negative input of amplifier 90. Consequently, the voltage change at input 56 does not yet effect a change in the output voltage of amplifier 90. However, once the voltage at input 60 drops to zero, the transistor 86 becomes nonconductive, and the resistor 87 is connected in parallel with resistor 91 via diode 89. Thereby the potential at the negative input of the amplifier 90 rises, namely to above the value present at the positive input. Thereby amplifier 90 is switched over and, due to the positive feedback, the potential at the positive input of the amplifier is reduced. The output signal of amplifier 90 thus remains preserved even with a changing voltage at the negative input, and a change occurs only when the transistor 96 is controlled to become conductive via input 56, and thus connects the positive input directly to the positive line 88. Accordingly, a zero signal will be present at output 62 only so long as the injection pulse $t_i$ lasts and at the same time the activating current has already been exceeded (FIG. 6*f*). During the application of this zero signal, the holding current can thus be maintained between a minimum and a maximum value. The high current threshold for the activating current thus falls with the range of a positive output signal at the output 62 of the logic gate circuit 58 and, correspondingly, the switch 75 can be switched on with this positive output signal for the high threshold value of current $I_1$.

Figure 7:
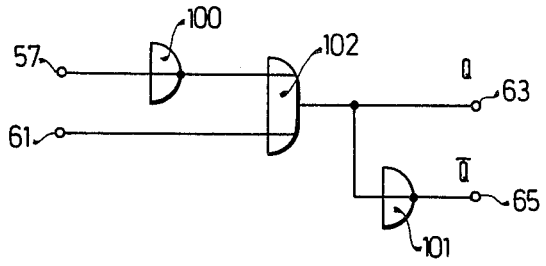
FIG. 7 is a detailed illustration of the logic gate 59 of FIG. 4.

FIG. 7 illustrates the logic gate circuit 59 with two inverters 100 and 101 as well as an OR gate 102. The input 57 of the logic gate circuit 59 is linked via the inverter 100 to a first input of the OR gate 102, whereas the second input 61 is connected directly to the second input of the OR gate 102. On the output side, the OR gate 102 is connected directly to output 63 and indirectly to output 65 via inverter 101.

Figure 8:
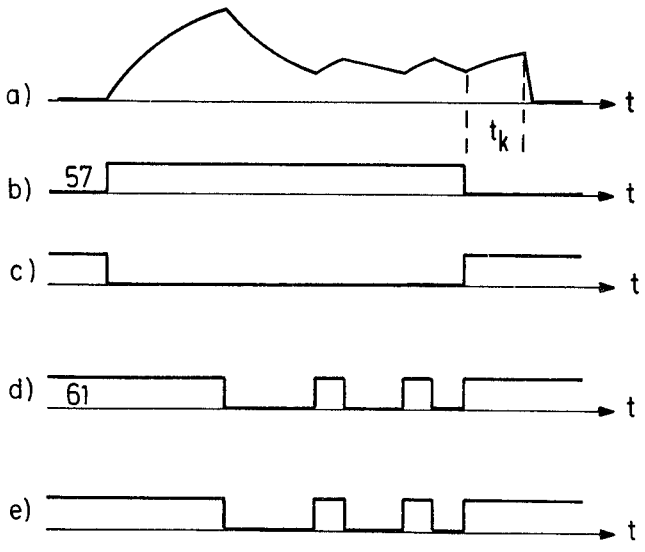
FIG. 8*a* illustrates the current profile and FIGS. 8*b* through 8*e* the pulse diagrams associated with the logic gate 59 of FIG. 7 for explaining the operation of the logic gate 59.

The diagrams of FIG. 8 serve for explaining the circuit arrangement according to FIG. 7. FIG. 8*a* again shows the valve current through the solenoid valves 20 and 21. FIG. 8*b* shows the signal corresponding to the injection signal $t_i$ at the input 57 of the logic gate circuit 59. At the output of inverter 100, the signal of FIG. 8*c* is produced. FIG. 8*d* represents the output signal of the threshold switch 68, corresponding to the signal at input 61. The signal at output 63 of the logic gate circuit 59 is finally shown in FIG. 8*e*. A comparison of the curves in FIGS. 8*a* and 8*e* shows that a zero potential at output 63 serves for the threshold value of the minimum current during the holding phase, while the positive signal marks the occurrence of the high current threshold during the holding phase.

Figure 9:
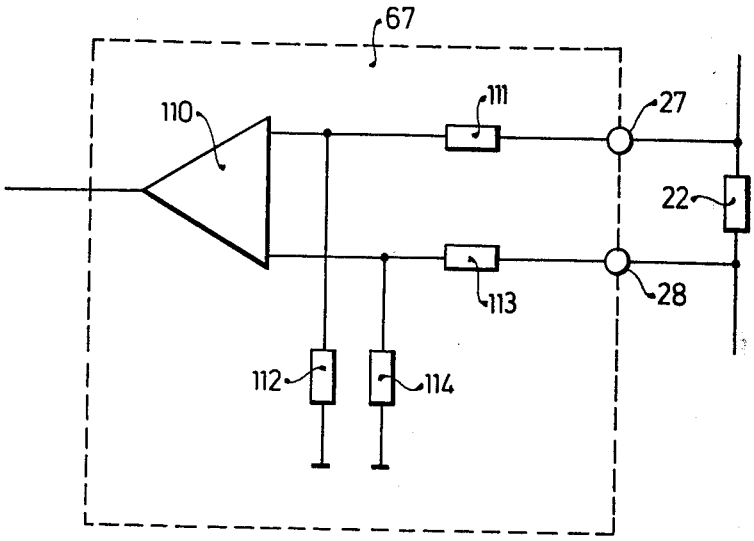
FIG. 9 is a detailed illustration of the differential amplifier 67 of FIG. 4.

FIG. 9 illustrates the differential amplifier 67. The input signals are applied to this differential amplifier 67 by the measuring resistor 22, and this differential amplifier comprises an operational amplifier 110, the inputs of which are connected respectively to the taps of two voltage dividers comprising resistors 111–114. The voltage divider consisting of resistors 111 and 112 is connected between input 27 and ground and, correspondingly, the voltage divider consisting of resistors 113 and 114 is connected between input 28 and ground. The voltage dividers employed serve to insure that the input potentials of amplifier 110 do not become larger than the positive potential of the supply voltage. This measure becomes absolutely necessary when the transistor 23 of the arrangement of FIG. 3 is switched off, because in this case the potential at measuring resistor 22 can assume voltage potentials above $U_{Bat}$ due to self induction, and with the aid of the voltage dividers from resistors 111–114, the input potential of the amplifier 110 can be maintained in any event lower than the battery voltage.

An essential factor in the above-described circuit arrangement for controlling a solenoid valve in an internal combustion engine is the circumstance that the current supply to the solenoid valve cuts off after reaching an activating or starting current and is contact-controlled during the holding phase. The switching points for transistor 23 are exclusively dependent on the current in this connection. Consequently, this transistor is switched in each instance after attaining specific current thresholds, which are detected by means of a measuring resistor 22.

Figure 10:
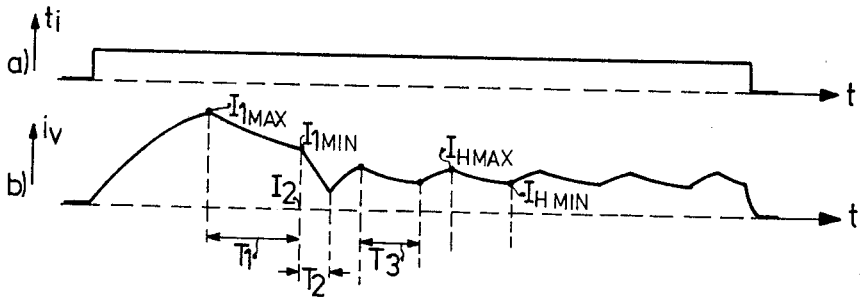
FIG. 10*a* illustrates the injection pulse $t_i$.
FIG. 10*b* shows the current profile according to FIG. 1*c* in greater detail with the reference to the injection pulse $t_i$ of FIG. 10*a;*

Cases are possible wherein the valve current, after reaching the activating current, is not supposed to fade immediately, to a great extent, and, above all, is not to fade over an extended period of time. If, for example, the injection valve tends toward a so-called chattering, then a higher current is desirable until the end of the chattering process than is subsequently desired during the holding phase. This entails an additional control of the current. Examples for such desired current curves can be seen, for example, from FIGS. 1*b* and 1*c*. The curve shown in FIG. 1*b* demonstrates a relatively high current flow up to a time $t_1$, and from then on the holding interval is entered into. This instant $t_1$ can be determined by means of a special current threshold or by means of a time control. A time control arrangement is shown in FIGS. 10 and 11, wherein the solid line curve is illustrated.

FIG. 10*a* shows the injection pulse $t_i$. FIG. 10*b* shows in greater detail the current flow curve according to FIG. 1*b*. The curve profile in FIG. 10*b* comprises current threshold values as well as times significant for the formation of this curve. A current rise can be seen up to the activating current value $^I1_{MAX}$, a subsequent fading of this current to a value $^I1_{MIN}$, followed again by a steep drop to the minimum holding current value $^IH_{MIN}$ Subsequently thereto, the current oscillates respectively between the two holding current values $^IH_{MAX}$ and $^IH_{MIN}$ to the end of the injection pulse $t_i$.

Figure 11:
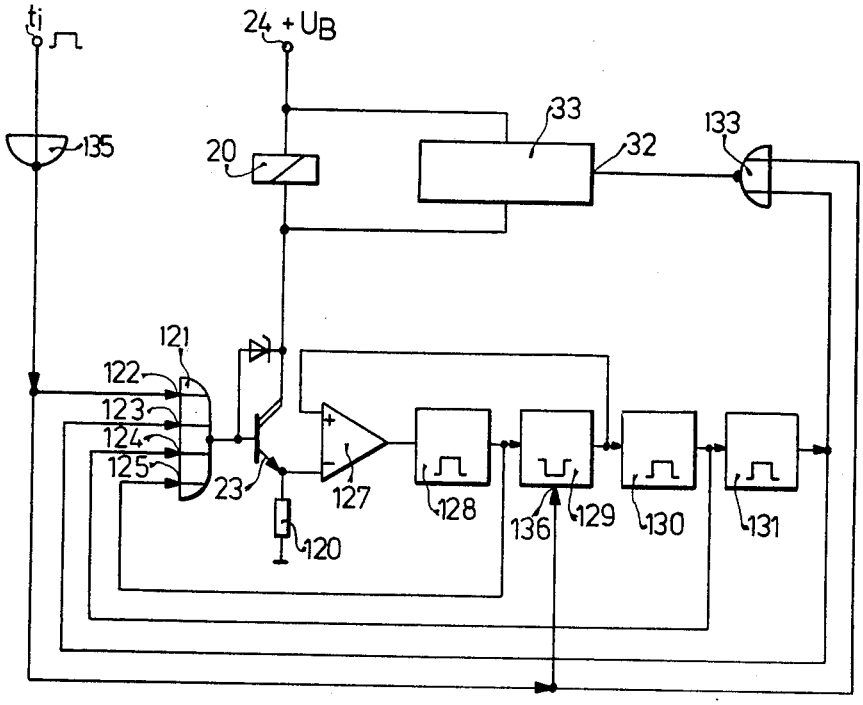
FIG. 11 illustrates a block circuit diagram for realizing the current profile shown in FIG. 10*b;*

FIG. 11 illustrates one possible circuit in block diagram form which produces the curve shown in FIG. 10*b*. The important component in FIG. 11 is a measuring resistor 120 located between transistor 23 and ground. As a result of this arrangement, only the maximum current values can be interrogated, whereas the duration of the respective nonconductive conditions of the transistor 23 must be chronologically controlled. For this reason, in accordance with the information derivable from FIG. 10*b*, the times $T_1$, $T_2$, $T_3$, etc. are being formed, during which the transistor 23 is respectively blocked. An advantage in this arrangement of the measuring resistor 120 is that it does not have any current flowing therethrough during the freewheeling periods and thus no power loss occurs in this resistor precisely during these freewheeling periods. The current drops in the solenoid valve 20 can be better smoothed out in this way, which, in turn, represents a lowering of the frequency of switching operations.

In the arrangement of FIG. 11, a NOR gate 121 with four inputs 122–125 is connected to the base of transistor 23. A series circuit of comparator 127, monostable multivibrator 128, bistable multivibrator 129, as well as two monostable multivibrators 130 and 313 follows the junction point of transistor 23 and resistor 120. The output of the monostable multibrator 128 is connected to the input 125 of the NOR gate 121. The output of the bistable multivibrator 129 is connected to the positive input of the comparison stage 127, and furthermore the output of the monostable multivibtator 130 is connected back to the input 124 of the NOR gate 121, and, finally, the output of the monostable multivibrator 131 is connected to the input 123 of the NOR gate 121 as well as to one of two inputs of a NOR gate 133. At the fourth input 122 of the NOR gate 121, the injection pulses $t_i$ are applied via an inverting stage 135, and the output of this inverting stage 135 is additionally connected to a control input 136 of the bistable multivibrator 129 and to the second input of the NOR gate 133. The output of the NOR gate 133 is connected to the control input of the freewheeling control circuit 33.

The circuit arrangement illustrated in FIG. 11 operates as follows:

Before the rising flank of an injection pulse $t_i$ the transistor 23 remains blocked, since it does not receive a positive control pulse due to dual inversion by inverter 135 and the NOR gate 121. Upon the occurrence of the injection pulse $t_i$ the transistor 23 becomes conductive and current will flow until the value $^I1_{MAX}$ has been reached. Upon reaching this current value, the monostable multivibrator 128 assumes its unstable condition, and its output signal blocks transistor 23 via the NOR gate 121. At the same time, the output of the bistable multivibrator 129 reaches a low potential, and with this descending flank the monostable multivibrator 130 is triggered. If, now, the monostable multivibrator 128 again flips back into its rest condition, the transistor 23 remains blocked due to the longer pulse duration of the monostable multivibrator 130. After elapse of the time period of the monostable multivibrator 130, the following multivibrator 131 is triggered. The output signal of the latter likewise blocks transistor 23 and simultaneously switches on the freewheeling circuit so that current flow in this freewheeling circuit is interrupted, leading to a rapid current drop. The transistor 23 becomes conductive only after the time $T_2$ has passed. The output signal of the multivibrator, however, effects a changeover of the threshold value of the comparator 127, and thus the transistor 23 is already blocked at maximum holding current $^IH_{MAX}$. Only after elapse of the injection pulse $t_i$ will the bistable multivibrator 136 return to its initial condition, and thus will again make available a high current threshold value. At the same time, the transistor 23 is blocked again via the inverter 135 and the NOR gate 121.

The individual groups of components of the circuit arrangement according to FIG. 11 are known per se. Consequently, there is no need for a separate explanation of the individual component groups.

Figure 12:
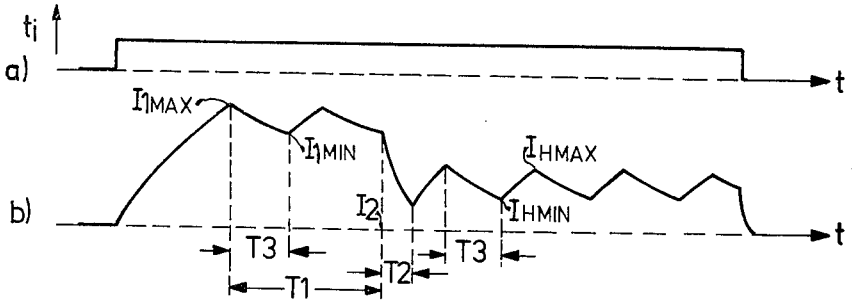
FIG. 12*a*, like FIG. 10*a*, illustrates the injection pulse $t_i$.
FIG. 12*b* shows correspondingly the pulse diagram of FIG. 1*b* in greater detail.
Figure 13:
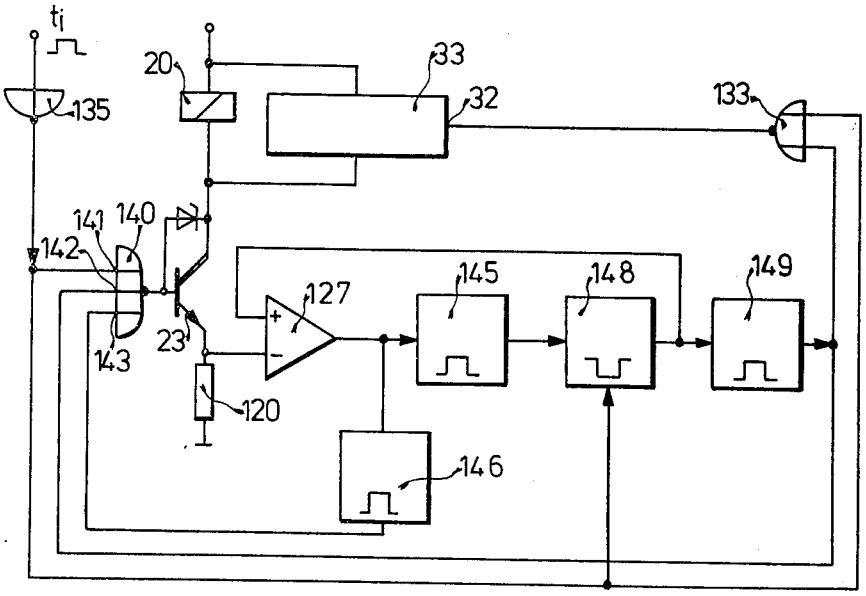
FIG. 13 illustrates a block circuit diagram for realizing the current profile shown in FIG. 12*b.

FIG. 12*b* shows, in greater detail, the current flow curve of FIG. 1*c*. The difference as compared to the curve in FIG. 10*b* is that the current through the solenoid valve is already timed prior to the holding phase. Otherwise, there is no change. The curve according to FIG. 12*b* can be realized with a circuit arrangement according to FIG. 13. Respectively one NOR gate 140 with three inputs 141, 142, and 143 is connected to the base of the transistor 23. The output of the comparator 127 is connected to two monostable multivibrators 145 and 146. While the output of the monostable multivibrator 146 is connected to the input 143 of the NOR gate 140, the output of the monostable multivibrator 145 is coupled to an input of a bistable multivibrator 148, the output of the latter being connected, in turn, to the positive input of the comparator 127 and furthermore to the input of another monostable multivibrator 149. The output of this monostable multivibrator 149 is connected, in turn, to an input of the NOR gate 133 as well as to the input 142 of the NOR gate 140. The remaining circuit of the arrangement shown in FIG. 13 corresponds to that of the circuit shown in FIG. 11.

Prior to the occurrence of the injection pulse $t_i$ the transistor 23 is nonconductive. With the beginning of the injection pulse $t_i$ the transistor 23 conducts until the activating current $^{I}H_{MAX}$ has been attained. Subsequently thereto the output signal of the monostable sultivibrator 146 blocks current flow via the NOR gate 140. At the same time, the monostable multivibrator 145 is triggered, the operating time of this multivibrator or flip-flop according to the illustration of FIG. 12*b* being longer than that of the monostable multivibrator 146. After the operating time of this last-mentioned multivibrator 146 has elapsed, the transistor 23 again conducts until $^{I}1_{MAX}$ has been reached, and so forth. Only when the operating time of the multivibrator 145 has passed does the bistable multivibrator 148 execute a switching step and transmit to the comparator 127 a lower threshold value. Simultaneously, the monostable multivibrator 149 is triggered and blocks, during its operating time $t_2$, the freewheeling circuit 33, and via the input 142 of the NOR gate 140, blocks the transistor 23. Subsequently, a rise of the valve current to the maximum value $^{I}H_{MAX}$ during the following holding interval occurs, and a corresponding drop occurs during a subsequent constant time period. After the injection pulse $t_i$ has ceased, the transistor 23 is again blocked via the inverter 135 and the NOR gate 140 and remains in this condition until the next rising flank of the injection pulse.

Figure 14:
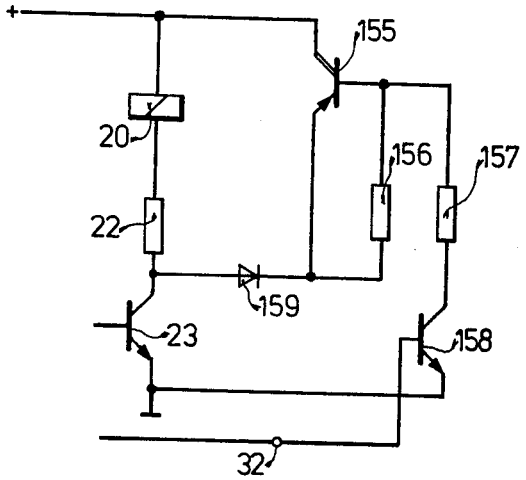
* and FIGS. 14 and 15 illustrate two embodiments of the freewheeling circuit 33 in parallel with the load.
Figure 15:
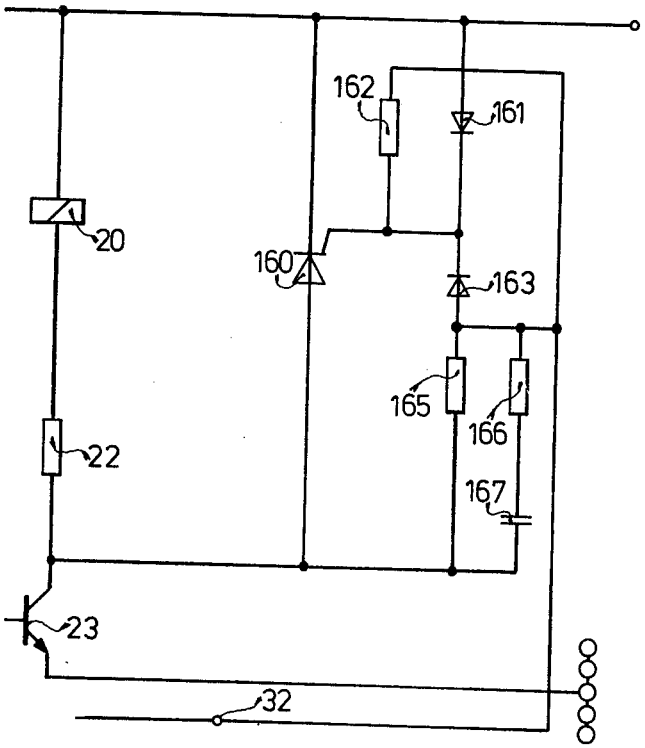

Exemplary embodiments of the freewheeling control circuit 33 are shown in FIGS. 14 and 15.

In the arrangement of FIG. 14, the freewheeling circuit comprises a transistor 155, the emitter-collector path of which is connected in parallel to the series circuit made up of valve 20 and the measuring resistor 22. A resistor 156 is connected between the base and emitter of the transistor 155. The transistor 155 is triggered via a resistor 157 by the collector of a transistor 158, the latter being connected to ground on the emitter side and the base of which is connected to the input 32 of the freewheeling control circuit. If no signal is applied to input 32 of the freewheeling control circuit 33, the transistor 158 is blocked and consequently transistor 155 is likewise nonconductive, so that no freewheeling current can flow. In case of a positive potential at input 32, however, the transistor 158, and consequently the transistor 155 conduct, and accordingly the current through the valve 20 and the measuring resistor 22 can fade gradually. A diode 159 connected in series with the transistor 155 serves to block the current flow when transistor 23 is conductive.

In the freewheeling control circuit of FIG. 15, a thyristor 160 serves as the freewheeling current switching means. The ignition electrode of this thyristor is connected to the positive potential line via a diode 161 and furthermore to the control input 32 via a parallel circuit of resistor 162 and diode 163. This control input 32 is additionally connected to the junction point of thyristor 160 and the collector of the switching transistor 23 by way of a parallel circuit of resistor 165 and a series connection of a resistor 166 and a capacitor 167.

The thyristor 160 is fired via the diode 163 by the capacitor recharging current as soon as the voltage at the collector of transistor 23 begins to rise. To limit the capacitor current, a resistor 166 is provided. Once the transistor 23 becomes conductive, the thyristor 160 blocks automatically due to the then-existing voltage relationships. If, for the introduction of the resetting operation, the thyristor 160 is to remain blocked, even with an increase in the collector voltage, the potential at the control input 32 is connected to ground potential. Thus, the capacitor recharging current is conducted away and at the same time, via the diode-resistor combination (161, 162) the trigger electrode of the thyristor 160 is rendered negative with respect to the cathode. The resistor 165 in parallel to capacitor 167 accelerates the recharging of the capacitor 167.

A rapid current drop through the solenoid winding of the solenoid valve 22 is a prerequisite for an unequivocal closing of an injection valve. This is ensured only if the freewheeling circuit 33 is cut out. With the use of thyristors in the freewheeling control circuit 33, however, problems are encountered in cutting off the freewheeling circuit if the transistor 23 is blocked directly prior to the end of the $t_i$ pulse, i.e., the injection pulse. In that case, a freewheeling current is flowing, and the switched-on thyristor cannot be brought into the blocked condition within the extremely short time desirable for this purpose. To repeat at will an exact switching-off process along the lines of an exactly timed operation, a brief trigger pulse is selected for the transistor 23 after the end of the actual injection pulse $t_i$. The associated pulse characteristic is shown in FIG. 2. This arrangement is realized by means of the timing member of the monostable multivibrator 52 illustrated in the system of FIG. 4, this multivibrator being triggered by the descending flank of the $t_i$ signal and effecting an additional conductive period of the transistor 23 for a predetermined interval $t_k$. Although in this circuit operation the actual injection time of the injection valve is extended by the time interval $t_k$, this additional time can already be taken into account during the formation and/or correction of the injection pulses $t_i$.

The above description relates to the control of injection valves in internal combustion engines. Apart from this practical example, the process of this invention and the associated apparatus can be employed in all those cases where electromagnetic loads with movable parts are to be controlled with a minimum of power and with maximum speed. With respect to this aspect, the invention also relates to the control of relays, for example. The essential point is that, after the activating current has been reached, a current, the level of which is above the holding current, is additionally made available for a certain period of time, so that the armature of the electromagnetic load is securely attracted, and chatter phenomena are, if at all possible, avoided. When using thyristors in the freewheeling circuit, it is advantageous to add a brief and defined additional trigger pulse for the current flow so that the freewheeling operation can be cut off from a respectively defined initial position of the voltage relationships at the electromagnetic load and in the freewheeling circuit proper.

What is claimed and desired to be secured by Letters Patent of the United States is:

1. A method of operating an electromagnetic load device including a movable armature, in particular the injection valve of an internal combustion engine, comprising the steps of:

(a) applying a high amperage starting current to the load device as a result of which the armature is set into motion;

(b) reducing the magnitude of the current before the armature reaches its final position; and (c) varying the current to the load thereafter such that any current rise is less than the starting current.

2. The method as defined in claim 1, wherein the magnitude of the current of the load device is reduced from the starting current after the armature is set into motion.

3. The method as defined in claim 1, wherein the magnitude of the current to the load device is varied in chronologically staggered fashion.

4. The method as defined in claim 1, wherein the reduction and variation in the magnitude of the current supplied to the load device proceeds in predetermined time sequences.

5. The method as defined in claim 1, wherein the reduction and variation in the magnitude of the current supplied to the load device proceeds in a controlled manner.

6. The method as defined in claim 1, wherein the reduction and variation in the magnitude of the current supplied to the load device proceeds in a controlled manner and in predetermined time sequences.

7. The method as defined in claim 1, wherein the point at which the current to the load device commences to be reduced is dependent on the current.

8. The method as defined in claim 1, wherein the point at which the current to the load device commences to be reduced is dependent on time.

9. The method as defined in claim 1, wherein the point at which the current to the load device commences to be reduced is dependent on current and time.

10. The method as defined in claim 1, wherein a freewheeling circuit is connected to the load device, and wherein the magnitude of the current to the load device is reduced and varied by switching the freewheeling circuit at selected time intervals.

11. The method as defined in claim 10, wherein the current flow to the freewheeling circuit is terminated during switching at the selected time intervals.

12. The method as defined in claim 10, wherein steps (a), (b) and (c) are triggered and sustained by a control pulse, and wherein the current flow through the load device is increased for a predetermined time period at the termination of said control pulse.

13. An apparatus for controlling the current flow through an electromagnetic load device having an armature and a stop, comprising:

(a) a current measuring element and a switching element connected in series to the load device; and (b) a threshold switch connected to the current measuring element and the switching element for controlling the operation of the switching element, wherein the switching thresholds of the threshold switch are controllable as a function of the current flowing through the load device, and wherein the initial switching threshold occurs when the armature is set into motion but has not reached its final position.

14. The apparatus as defined in claim 13, further comprising:

(c) a freewheeling control circuit connected to the load device, the current measuring element and the switching element, wherein the freewheeling control circuit is activated when the initial switching threshold occurs.

15. The apparatus as defined in claim 14, wherein the freewheeling control circuit can be activated and deactivated according to a predetermined time sequence.

16. The apparatus as defined in claim 14, wherein the freewheeling control circuit can be activated and deactivated according to the magnitude of the current flowing through the load device.

17. The apparatus as defined in claim 14, wherein the freewheeling control circuit can be activated and deactivated according to a predetermined time sequence and the magnitude of the current flowing through the load device.

18. The apparatus as defined in claim 14, wherein the freewheeling control circuit comprises: a control input; a thyristor connected in parallel, at least with the load device; a diode, through which the control electrode of the thyristor is connected to a positive line of potential; a parallel circuit including a resistor and a further diode, through which the control electrode of the thyristor is connected to the control input; and a capacitor, with the anode of the thyristor being connected to the control input at least by way of the capacitor.

19. The apparatus as defined in claim 14, wherein the current flowing through the load device is reduced following the initial switching threshold by the freewheeling control circuit to a holding current level at which the armature of the load device engages the stop, and wherein the level of the current between the initial switching threshold and the holding current level is maintained constant by the freewheeling circuit.

20. The apparatus as defined in claim 19, further comprising:

(c) a multistage voltage divider connected to the current measuring element; and (d) a variable resistor connected between the stages of the multistage voltage divider, wherein the initial switching threshold value is determined by the multistage voltage divider and controlled by the variable resistor.

21. The apparatus as defined in claim 19, further comprising:

(c) a multistage voltage divider connected to the current measuring element; and (d) a variable resistor connected between the stages of the multistage voltage divider, wherein the holding current level is determined by the multistage voltage divider and controlled by the variable resistor.

22. The apparatus as defined in claim 19, further comprising:

(c) a multistage voltage divider connected to the current measuring element; and (d) a variable resistor connected between the stages of the multistage voltage divider, wherein the initial switching threshold value and the holding current level are determined by the multistage voltage divider and controlled by the variable resistor.

23. The apparatus as defined in claim 14, wherein the current flowing through the load device is reduced following the initial switching threshold by the freewheeling control circuit to a holding current level at which the armature of the load device engages the stop, and wherein the level of the current between the initial switching threshold and the holding current level is continuously varied by the freewheeling circuit.

24. The apparatus as defined in claim 23, further comprising:

(c) a multistage voltage divider connected to the current measuring element; and (d) a variable resistor connected between the stages of the multistage voltage divider, wherein the initial switching threshold value is determined by the multistage voltage divider and controlled by the variable resistor.

25. The apparatus as defined in claim 23, further comprising:

(c) a multistage voltage divider connected to the current measuring element; and (d) a variable resistor connected between the stages of the multistage voltage divider, wherein the holding current level is determined by the multistage voltage divider and controlled by the variable resistor.

26. The apparatus as defined in claim 23, further comprising:

(c) a multistage voltage divider connected to the current measuring element; and (d) a variable resistor connected between the stages of the multistage voltage divider, wherein the initial switching threshold value and the holding current level are determined by the multistage voltage divider and controlled by the variable resistor.

27. The apparatus as defined in claim 13, further comprising:

(c) a timing member connected to the switching element, wherein the duration of the current flow through the load device coincides with the duration of a trigger pulse applied to the circuit comprising the current measuring element, the switching element and threshold switch, and wherein the duration of the current flow can be increased by the timing member.

28. The apparatus as defined in claim 13, wherein the switching element is connected between the load device and the current measuring element, and wherein the switching element is switched, in part, as a function of time and in part as a function of the current flow through the load device.

29. The apparatus as defined in claim 13, further comprising:

(c) a control circuit for the switching element, wherein the control circuit is controlled as a function of the current flow through the load device.

* * * * *